US010371023B2

(12) United States Patent
Negre et al.

(10) Patent No.: US 10,371,023 B2
(45) Date of Patent: Aug. 6, 2019

(54) COMPRESSED-AIR ENGINE WITH AN INTEGRATED ACTIVE CHAMBER AND WITH ACTIVE INTAKE DISTRIBUTION

(71) Applicants: MOTOR DEVELOPMENT INTERNATIONAL S.A., Luxembourg (LU); Cyril Negre, Nice (FR)

(72) Inventors: Guy Negre, Luxembourg (LU); Cyril Negre, Nice (FR)

(73) Assignee: MOTOR DEVELOPMENT INTERNATIONAL S.A., Luxembourg (LU)

( * ) Notice: Subject to any disclaimer, the term of this patent is extended or adjusted under 35 U.S.C. 154(b) by 179 days.

(21) Appl. No.: 15/312,828

(22) PCT Filed: May 18, 2015

(86) PCT No.: PCT/EP2015/060855
§ 371 (c)(1),
(2) Date: Nov. 21, 2016

(87) PCT Pub. No.: WO2015/177076
PCT Pub. Date: Nov. 26, 2015

(65) Prior Publication Data

US 2017/0211435 A1 Jul. 27, 2017

(30) Foreign Application Priority Data

May 22, 2014 (FR) ..... 14 54603

(51) Int. Cl.
*F01L 9/02* (2006.01)
*F01B 17/00* (2006.01)
(Continued)

(52) U.S. Cl.
CPC ..... *F01L 9/026* (2013.01); *F01B 17/00* (2013.01); *F01B 17/02* (2013.01); *F01L 2003/258* (2013.01)

(58) Field of Classification Search
CPC . F01B 25/10; F01L 1/465; F01L 9/026; F01L 13/0015; F01L 25/06; F01L 2003/258
See application file for complete search history.

(56) References Cited

U.S. PATENT DOCUMENTS 213,435 A * 3/1879 Cameron ..... F01L 25/06 91/307
896,439 A * 8/1908 Criner ..... F01L 1/465 123/90.14
(Continued)

FOREIGN PATENT DOCUMENTS

DE 1 042 607 B 11/1958
DE 20 2005 017 622 U1 1/2006
(Continued)

OTHER PUBLICATIONS

International Search Report, dated Nov. 27, 2015, from corresponding PCT Application.

*Primary Examiner* — Michael Leslie
*Assistant Examiner* — Matthew Wiblin
(74) *Attorney, Agent, or Firm* — Young & Thompson

(57) ABSTRACT

An active chamber engine, includes at least one piston (2) slidingly mounted in a cylinder (1) and operating according to a three-phase thermodynamic cycle including an isobaric and isothermal transfer, a polytropic expansion with work and an exhaust at ambient pressure, which is preferably supplied with compressed air contained in a high-pressure storage tank (12), in which the volume of the cylinder (1) swept by the piston is divided into an active chamber (CA) and an expansion chamber (CD), and in which the compressed air is used to move the intake valve (9) in order to
(Continued)

open and then close the intake duct, making it possible to supply the active chamber of the engine, the compressed air having been used for the actions then being reused in the engine to produce additional work.

9 Claims, 7 Drawing Sheets

(51) Int. Cl.
*F01B 17/02* (2006.01)
*F01L 3/00* (2006.01)

(56) References Cited

U.S. PATENT DOCUMENTS 920,991 A * 5/1909 Perrault ..... F01L 1/465 123/90.14
955,786 A * 4/1910 Frear ..... F01L 1/465 123/63
1,942,711 A * 1/1934 Ernest ..... F01B 25/10 137/629
3,410,304 A * 11/1968 Paul, Jr. ..... F16K 17/042 137/494
7,377,249 B1 5/2008 Dingle
2004/0261415 A1 12/2004 Negre et al.
2005/0224059 A1 10/2005 Negre et al.
2007/0101712 A1 5/2007 Negre et al.
2008/0251041 A1 10/2008 Lou
2009/0211546 A1* 8/2009 Hedman ..... F01L 9/02 123/90.12
2010/0282225 A1* 11/2010 Gilbert ..... F01L 9/026 123/70 R
2011/0277711 A1 11/2011 Gonigman et al.
2013/0167520 A1 7/2013 Negre et al.
2013/0239563 A1 9/2013 Negre et al.

FOREIGN PATENT DOCUMENTS

DE 10 2009 052 385 A1 5/2011
WO 03/036088 A1 5/2003
WO 2005/049968 A1 6/2005
WO 2008/028881 A1 3/2008
WO 2009/023080 A1 2/2009
WO 2012/045693 A1 4/2012
WO 2012/045694 A1 4/2012
WO 03/089764 A1 10/2013

* cited by examiner

COMPRESSED-AIR ENGINE WITH AN INTEGRATED ACTIVE CHAMBER AND WITH ACTIVE INTAKE DISTRIBUTION

TECHNICAL FIELD OF THE INVENTION

The invention relates to an engine operating in particular with compressed air, or any other gas, and using a chamber called an "active chamber".

The invention relates to distribution to the intake of such an engine and more particularly an engine including an included active chamber and notably a multi-mode self-pressure-regulating engine with included active chamber.

PRIOR ART

The term distribution refers to all of the means used to feed such an engine with compressed gas.

The inventors have filed numerous patents relating to motor drives and their installations, using gases and more particularly compressed air for totally clean operation in urban and suburban sites:

They have notably filed an international patent application WO-A1-03/036088, to the content of which reference can be made, relating to an additional compressed air injection motor-compressor—motor-alternator set operating on a single energy and multiple energies.

In these types of engine operating with compressed air and comprising a compressed air storage tank, it is necessary to expand the compressed air stored at very high pressure in the tank—but whose pressure decreases as the tank empties—to a stable intermediate pressure called final pressure of use, in a buffer vessel—called working vessel—before it is used in the drive cylinder or cylinders of the engine.

To solve the pressure regulator problems, the inventors have also filed a patent application WO-A1-03/089764, to the content of which reference can be made, relating to a variable throughput dynamic pressure regulator and a distribution for engines fed with compressed air injection, comprising a high-pressure compressed air tank and a working vessel.

In the operation of these "load relieving" engines, the filling of the expansion chamber always represents an expansion without work that is detrimental to the overall efficiency of the machine.

To solve the above problem, the inventors then filed a patent application WO-A1-2005/049968 describing a compressed air engine preferentially fed with compressed air or any other compressed gas contained in a storage tank at high pressure, previously expanded to a nominal working pressure in a buffer vessel called working vessel.

According to the teachings of WO-A1-2005/049968 in this type of engine:

- the expansion chamber is made up of a variable volume equipped with means making it possible to produce work, and it is twinned and in contact via a permanent passage with the space contained above the main drive piston that is equipped with a device for stopping the piston at its top dead center point,
- during the stopping of the travel of the drive piston at its top dead center point, the air or the gas under pressure is admitted into the expansion chamber when the latter is at its smallest volume and, under the thrust, will increase its volume while producing work,
- with the expansion chamber being maintained substantially at its maximum volume, the compressed air which is contained therein then expands into the engine cylinder, thus pushing back the drive piston in its downstroke, while producing work in its turn,
- during the upstroke of the drive piston during the exhaust phase, the variable volume of the expansion chamber is returned to its smallest volume to recommence a complete work cycle.

The expansion chamber of the engine according to this invention actively participates in the work. The engine is thus called "active chamber" engine.

The document WO-A1-2005/049968 notably teaches a thermodynamic cycle in four phases during its operation in compressed air single-energy mode characterized by:

- an isothermal expansion without work;
- a transfer—slight expansion with so-called quasi-isothermal work;
- a polytropic expansion with work;
- an exhaust at ambient pressure.

The document WO-A1-2008/028881, which presents a variant of the teachings of the document WO-A1-2005/049968, teaches the same thermodynamic cycle but using a conventional connecting rod and crank device, the expansion chamber of the engine according to the invention actively participating in the work.

The inventors then filed a patent application for a compressed air or gas engine with included active chamber which implements the same thermodynamic cycle as the engines according to the teachings of WO-A1-2005/049968 and WO-A1-2008/028881 as well as a conventional connecting rod and crank device.

According to the teachings of the document WO-A1-2012/045693, the inventors have proposed an included active chamber engine comprising at least one piston mounted to slide in a cylinder and driving a crankshaft by means of a conventional connecting rod and crank device and operating according to a thermodynamic cycle with four phases comprising:

- an isothermal expansion without work;
- a transfer—slight expansion with so-called quasi-isothermal work;
- a polytropic expansion with work;
- an exhaust at ambient pressure.

Preferentially fed with compressed air, or any other compressed gas, contained in a storage tank at high pressure, through a buffer vessel called working vessel which is fed by compressed air or any other compressed gas contained in a storage tank at high pressure, which is expanded at an average pressure called working pressure in a working vessel, preferentially via a dynamic pressure-regulating device, in which:

- the active chamber is included/incorporated in the engine cylinder;
- the engine cylinder comprises at least one piston mounted to slide in at least one cylinder, in which the volume swept by the piston is divided into two distinct parts, a first part constituting the active chamber CA and a second part constituting the expansion chamber CD;
- the cylinder is closed at its top part by a cylinder head comprising at least one intake duct and one intake orifice and at least one exhaust duct and one exhaust orifice and which is formed in such a way that, when the piston is at its top dead center point, the residual volume contained between the piston and the cylinder head is, by construction, if not non-existent, reduced to just the minimum gaps allowing contactless operation between the piston and the cylinder head;
- the compressed air or the gas under pressure is admitted into the cylinder above the piston when the volume of the active chamber CA is at its smallest volume and which, under the continuous thrust of the compressed air at constant working pressure, will increase in volume while producing work representing the quasi-thermal transfer phase;

the intake of the compressed air or of the gas under pressure into the cylinder is blocked when the maximum volume of the active chamber CA is reached, and the quantity of compressed air or of the gas under pressure contained in said active chamber then expands, pushing back the piston over the second part of its travel which defines the expansion chamber CD while producing work thus ensuring the expansion phase;

the piston having reached its bottom dead center point, the exhaust orifice is then opened to ensure the exhaust phase during the upstroke of the piston over all of its travel.

The volume of the included active chamber CA and the volume of the expansion chamber CD are dimensioned in such a way that at the nominal operating pressure of the engine the pressure at the end of expansion at the bottom dead center point is close to the ambient pressure, notably atmospheric pressure. The volume of the active chamber is determined by the closure of the intake.

Advantageously, and notably in compressed air single-energy operation, the included active chamber engine described above includes a plurality of successive cylinders of increasing cubic capacity.

Preferentially the engine is fed in a manner after the teachings of the documents WO-A1-2005/049968 and WO-A1-2008/028881, by compressed air or by any other compressed gas contained in a storage tank at high pressure, previously expanded to a nominal working pressure in a buffer vessel called working vessel.

However, even if it is possible in the case of an engine with a plurality of stages to feed the first of the cylinders at high pressures, it is still necessary to expand the air compressed at very high pressure contained in the storage tank at high pressure to a nominal working pressure and this expansion operation either provokes a loss of efficiency through the use of a conventional pressure regulator or, with the use of the teachings of WO-A1-03/089764, incurs no energy cost, but this expansion does not make it possible to perform any expansion work between the high pressure contained in the tank and the nominal working pressure in the constant volume working vessel.

The inventors then filed a new patent application WO-A1-2012/045694 to the content of which reference can be made that claims an included active chamber compressed air engine in which:

the storage tank of compressed air at high pressure or of any other gas under pressure directly feeds the intake of the engine cylinder;

the included active chamber CA is filled at a constant intake pressure on each engine revolution, this intake pressure decreasing as the pressure in the storage tank decreases during the progressive emptying of this tank;

the volume of the included active chamber CA is variable and is progressively increased as the pressure in the storage tank which determines said intake pressure decreases;

the means for opening and closing the intake of compressed air into the included active chamber CA make it possible not only to open the intake orifice and duct substantially at the top dead center point of the travel of the piston but also to modify the intake duration and/or angular sector, as well as the passage section of the opening;

the volume of the included active chamber CA is dimensioned for the maximum storage pressure, then is progressively increased so that, depending on the intake pressure, on the ratio of volumes between the included active chamber CA and the expansion chamber CD, the pressure at the end of expansion before opening of the exhaust is close to atmospheric pressure.

The engine according to WO-A1-2012/045694 serves also as pressure regulator, the invention thus making it possible to propose a so-called "self-pressure-regulating" engine which requires no independent pressure regulator, regardless of its type, to feed the active chamber CA.

The multi-mode self-pressure-regulating engine with included active chamber according to the teachings of the document WO-A1-2012/045694 notably implements, when in its operation in compressed air single-energy mode, a thermodynamic cycle with three phases including:

an isobaric and isothermal transfer phase;

a polytropic expansion with work phase;

an exhaust phase at ambient pressure.

In the operation of this engine, the volume, varying as a function of the pressure of the high-pressure storage tank, of the included active chamber determines the quantity of compressed air injected. The higher the intake pressure, the smaller the volume of the active chamber has to be.

In order to obtain correct operation in all phases of use of the engine it is therefore necessary to feed it with great accuracy as a function of various parameters including the speed or rotation speed, the intake pressure, the load determined by the position of the accelerator, the temperature.

To this end, it is necessary to be able to vary:

the moment of opening the intake as a function of the rotation speed of the engine before or after the top dead center point to take account of the inertias of the gases and also of the ratio between the pressure establishment times, the moment of closing the intake as a function of the rotation speed of the engine but also of the intake pressure, the lifting of the intake valve as a function of the required load.

The difficulty lies in producing means for opening and closing the intake of compressed air into the included active chamber that make it possible not only to open the intake orifice and duct substantially at the top dead center point of the travel of the piston but also to modify the intake duration and/or angular sector as well as the passage section of the opening.

The distribution of engines of all types is generally provided by valves the operation of which is well known. A valve blocks the intake and/or exhaust duct and includes a valve head pressed by springs onto a circular valve seat formed around a orifice putting the intake duct and/or exhaust duct into communication with the combustion chamber and/or expansion chamber contained in the cylinder.

The valve head opens the circuit by penetrating into the chamber to be fed when moved by mechanical systems of cams and cam-followers acting on the stem of the valve that extends the head of the valve.

In other engine fields and for other technical reasons notably concerning pollution reduction and with the aim of controlling the intake and exhaust of conventional internal combustion engines, many engine manufacturers are working on systems making it possible to control the phasing and the duration of valve opening during operation and have filed numerous patents concerning those applications. Complex mechanical systems driven by electric stepper motors have also been developed and put onto the market, notably by BMW (registered trade mark) with the so-called "Vamos" device.

The inventors have also filed patent application WO-A1-03/089764 to the content of which reference may be made relating to distribution via progressively controlled valves.

Much work has been undertaken on electromechanical devices, notably controlled by solenoids that are easy to control so as to take into account the various operating parameters, but the electrical powers that have to be deployed to make possible the acceleration and the speed of movement of the valves are considerable, given their weight and inertia.

The invention, notably suitable for active chamber compressed air engines, and notably included active chamber multi-mode self-pressure-regulating engines, proposes to solve all of the problems referred to above whilst producing an increase in power.

The intake active distribution device according to the invention applied to compressed air engines uses the compressed air contained in the high-pressure storage tank and/or in the intake circuit to move the intake valve in order to open and then to close the intake duct enabling feeding of the active chamber of the engine, the compressed air having been used to perform these actions thereafter being re-used in the engine to produce additional work.

BRIEF SUMMARY OF THE INVENTION

The invention proposes an active chamber engine operating according to a three-phase thermodynamic cycle including:

an isobaric and isothermal transfer phase;

a phase of polytropic expansion with work;

an exhaust phase at ambient pressure;

this engine including:

at least one cylinder fed with a gas under pressure, preferably with compressed air, contained in a high-pressure storage tank, at least one piston that is mounted to slide in that cylinder, a crankshaft driven by the piston by means of a conventional connecting rod and crank device, a cylinder head that closes the volume of the cylinder at the top, which is swept by the piston, and which includes at least one intake duct in which flows a flow of gas under pressure for filling the cylinder, an intake orifice for the gas under pressure above the piston, and at least one exhaust orifice and one exhaust duct, the cylinder head being arranged so that, when the piston is at its top dead center point, the residual volume contained between the piston and the cylinder head is, by construction, reduced to just the minimum gaps enabling contactless operation between the piston and the cylinder head, at least one intake valve that cooperates in a sealed manner with a valve seat formed in the cylinder head and which defines the intake orifice, in which engine:

the volume of the cylinder swept by the piston is divided into two distinct parts, a first part constituting an active chamber that is included in the cylinder and a second part constituting an expansion chamber, under the continuous thrust of the gas under pressure admitted into the cylinder, at constant working pressure, the volume of the active chamber increases and produces work representing the isobaric and isothermal transfer phase, the admission of the gas under pressure into the cylinder is blocked as soon as the maximum volume of the active chamber is reached, the quantity of gas under pressure contained in said active chamber then expanding and pushing back the piston over the second part of its travel which defines the expansion chamber and produces work therefore ensuring the polytropic expansion phase, the piston having reached its bottom dead center point, the exhaust orifice is then opened to ensure the exhaust phase during the upstroke of the piston over the entirety of its travel to its top dead center point, the torque and the speed of the engine are controlled by opening and closing the intake valve enabling opening of the intake valve substantially at the top dead center point of the travel of the piston and making it possible, by closing the valve, to modify the intake duration and/or angular sector, as well as the passage section of the intake orifice in order, as a function of the pressure of the compressed gas contained in the storage tank and the pressure at the end of the expansion phase, to define the quantity of gas under pressure admitted and the volume of the active chamber, characterized in that:

a) the intake valve is mounted to be mobile in axial displacement between a low closed position in which it bears in a sealed manner on its valve seat and a high open position, b) in its opening direction, the intake valve moves axially in the direction opposite to that of the flow of the flow of gas under pressure for filling the cylinder, c) in its closed position, the intake valve is maintained closed in an autoclave manner on its valve seat by the pressure in the intake duct and applied to the intake valve, d) the engine includes means for controlling opening of the intake valve, substantially at the top dead center point of the travel of the piston, to cause the intake valve to lift off its seat to enable the establishing of the intake pressure in the active chamber, the valve then travelling its complete opening travel under the action of the differential pressure forces exerted by the gas under pressure on the corresponding parts of the intake valve, e) the engine includes a pneumatic actuator for closing the intake valve that includes an actuator cylinder and a closing piston that is connected to the intake valve to move axially with it and that it is mounted to slide in the actuator cylinder inside which it defines in a sealed manner a control chamber of the actuator, called closure chamber, f) the engine includes at least one channel that connects the intake duct (8) to a source of gas under pressure that is the upper part of the active chamber of the cylinder or the intake duct or the tank of gas under pressure, g) the engine includes an active distribution channel that connects said closure chamber to the upper part of the active chamber and a valve for blocking the circulation of the gas in the active distribution channel, called active distribution valve, the opening of which is controlled to place the closure chamber in communication with the upper part of the active chamber, to close the intake valve and to produce work that is added to the work of the charge of gas under pressure previously admitted into the active chamber via the intake duct.

According to other features of the invention:

the active distribution valve is controlled according to the following cycle:

i) opening of the active distribution valve to put the closure chamber in communication with the active chamber to cause the closing of the intake valve and then, during the expansion phase, to enable the expansion of the compressed gas contained in the closure chamber into the expansion chamber of the cylinder, producing work that is added to the work of the charge of gas under pressure previously admitted into the active chamber via the intake duct;

ii) at the end of the expansion phase, reclosing of the active distribution valve to maintain in the interior of the closure chamber the pressure of the expanded gas the value of which is close to that of atmospheric pressure;

according to a first embodiment, said means d) for controlling the opening of the intake valve include:

d1) said that connects the upper part of the active chamber to the intake duct or to the tank of gas under pressure, said channel then serving as channel controlling opening of the intake valve;

d2) a controlled valve for blocking the circulation of the gas in the channel for controlling opening, called opening valve;

said opening control valve is controlled according to the following cycle:

k1) at the end of the exhaust phase, when the piston is substantially at the top dead center point of its travel, opening said valve to make it possible to establish in the active chamber a pressure identical to that in the intake duct and to cause the intake valve to lift off its seat;

k2) the intake valve then travels its complete opening travel under the action of the differential pressure forces exerted by the gas under pressure on the corresponding parts of the intake valve;

k3) closing said valve as soon as the intake valve opens;

the engine includes a channel that connects said closure chamber to the intake duct and/or to the tank of gas under pressure and a valve for blocking the circulation of the gas in this channel the opening and then the closing of which are controlled so as to cause the closing of the intake valve, before the closure chamber is put into communication with the volume of the cylinder swept by the piston;

according to a second embodiment, said means for controlling opening of the intake valve include a finger upstanding on the upper face of the piston which, during the end of the travel of the piston toward its top dead center point, acts via the intake orifice on a facing orifice of the intake valve to lift it off its seat;

the active distribution valve is controlled according to the following cycle:

j) opening the active distribution valve to put the closure chamber in communication with the active chamber to put the closure chamber in communication with the expansion chamber of the cylinder to enable the expansion of the compressed gas contained in the closure chamber into the expansion chamber of the cylinder, producing work that is added to the work of the charge of gas under pressure previously admitted into the active chamber;

jj) at the end of the expansion phase, reclosing the active distribution valve to maintain in the interior of the closure chamber a pressure the value of which is close to that of atmospheric pressure;

the high maximum open position of the intake valve is defined by an adjustable stop the axial position of which in the direction of movement of the intake valve is controlled so as to vary the flow rate of gas under pressure admitted into the cylinder via the intake duct.

BRIEF DESCRIPTION OF THE FIGURES

Other aims, advantages and features of the invention will become apparent on reading the non-limiting description of a number of embodiments given in light of the appended drawings in which:

FIGS. 1B to 1D are views analogous to that of FIG. 1A in which the engine is shown in different successive phases of operation of the engine according to the invention and in which FIG. 1B represents the engine during the intake phase, the intake valve having been opened immediately on reaching the top dead center point;

DETAILED DESCRIPTION OF THE FIGURES

Description of FIGS. 1A to 1D

Figure 1A:
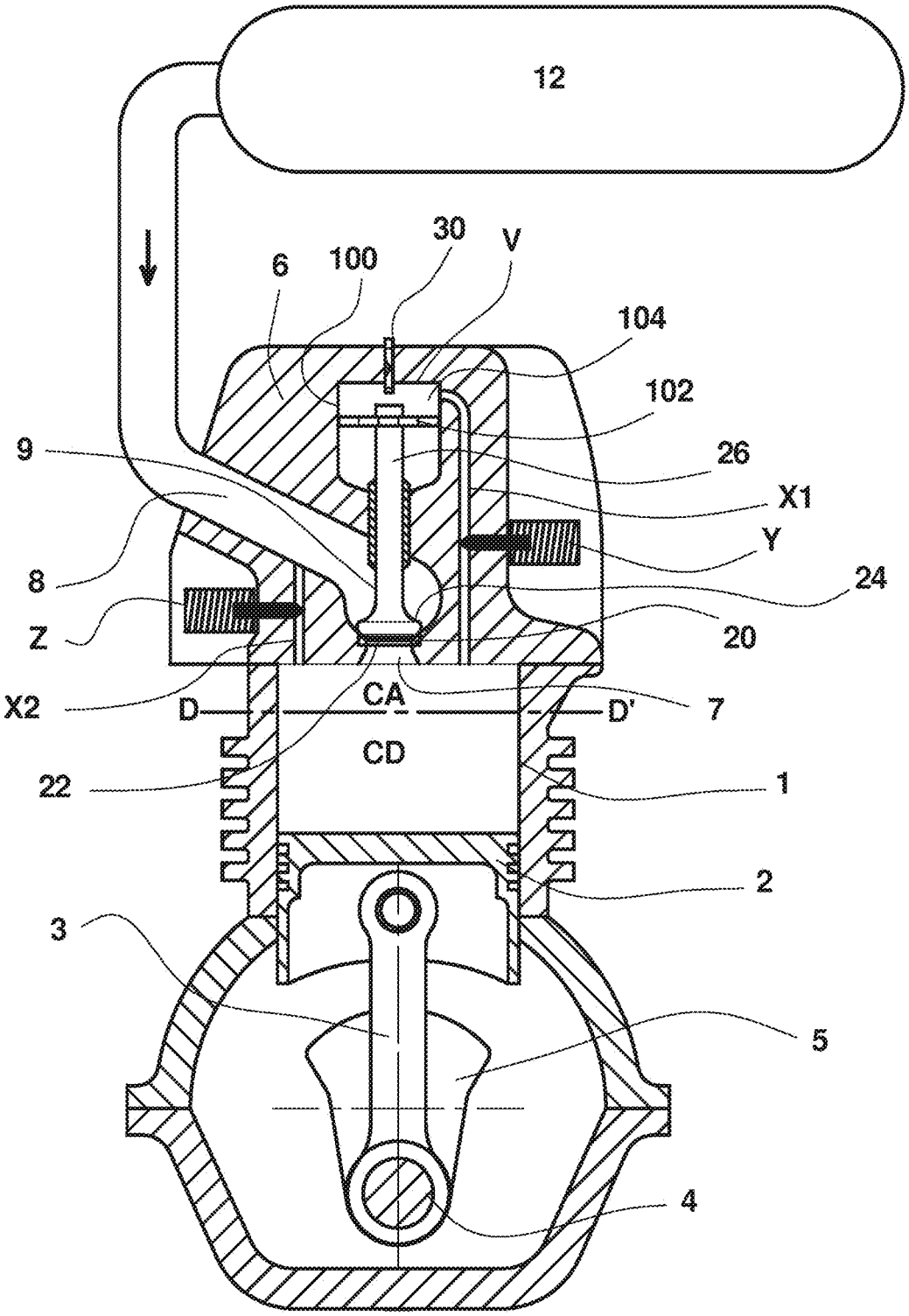
FIG. 1A schematically represents an engine according to the invention with active chamber included in the cylinder which is illustrated in axial section, represented at its bottom dead center point and with its compressed air feed device.

FIG. 1A represents a self-pressure-regulating engine with active chamber equipped with an intake active distribution system according to the invention.

There has been represented in FIGS. 1A to 1D an engine with active chamber CA operating according to a three-phase thermodynamic cycle including:

an isobaric and isothermal transfer phase;

a phase of polytropic expansion with work;

an exhaust phase at ambient pressure.

The engine includes at least one cylinder 1, only one of which is represented, which is fed with a gas under pressure, preferably with compressed air, contained in a high-pressure storage tank 12.

The engine includes a piston 2 that is mounted to slide in this cylinder 1 and a crankshaft 5 that is driven by the piston 2 by means of a conventional connecting rod and crank device 3, 4.

The volume of the engine cylinder 1 that is swept by the piston 2 is divided along an imaginary line DD' (corresponding to a dividing plane orthogonal to the axis of the cylinder) into two parts: a first part constituting the active chamber CA, which is therefore included in the cylinder 1, and a second part constituting the expansion chamber CD.

The engine further includes a cylinder head 6 that closes the volume of the cylinder 1 that is swept by the piston 2 at the top.

The cylinder head 6 includes at least one intake duct 8 that is connected to the tank 12 and in which flows the flow of gas under pressure for filling the cylinder, an intake orifice 7 for the gas under pressure above the piston 2.

The cylinder head further includes at least one exhaust orifice and one exhaust duct (not represented).

The cylinder head 6 is such that, when the piston 2 is at its top dead center point, the residual volume contained between the piston 2 and the cylinder head 6 is, by construction, reduced to just the minimum gaps enabling contactless operation between the piston 2 and the cylinder head 6.

The cylinder head 6 includes at least one intake valve 9, one of which is shown, that cooperates in a sealed manner with a valve seat 20 that is formed in the cylinder head 6 and defines the intake orifice 7.

In known manner, in such an engine:

- the volume of the cylinder 1 swept by the piston 2 is divided into two distinct parts comprising a first part constituting a chamber CA called the active chamber that is included in the cylinder 1 and a second part constituting an expansion chamber CD,
- under the continuous thrust of the gas under pressure admitted into the cylinder 1 at constant working pressure, the volume of the active chamber CA increases, producing work representing the quasi-isothermal transfer phase,
- the admission of the gas under pressure into the cylinder 1 is blocked as soon as the chosen maximum volume of the active chamber CA is reached, the quantity of gas under pressure contained in the active chamber CA then expanding and pushing back the piston 2 over the second part of its travel that defines the expansion chamber CD, producing work thus ensuring the expansion phase,
- the piston 2 having reached its bottom dead center point, the exhaust orifice is then opened to provide the exhaust phase during the upstroke of the piston 2 over the entirety of its travel as far as its top dead center point.

The torque and the speed of the engine are controlled by controlling the opening and closing of the intake valve 9, making it possible to open the intake valve 9 substantially at the top dead center point of the travel of the piston (which is vertical according to the orientation in the figure), and making it possible, by closing the valve 9, to modify the intake duration and/or angular sector, as well as the passage section of the intake orifice in order, as a function of the pressure of the gas contained in the storage tank 12 and the pressure at the end of the expansion phase, to define the quantity of gas under pressure admitted and the volume of the active chamber CA.

The intake duct 8 is directly connected to the high-pressure tank 12 which therefore feeds the active chamber CA directly and is at the same pressure as the tank.

The pressure in the intake duct 8 is identical to that of the storage tank 12, for example of the order of 100 bar, and is greater than that in the active chamber CA and the expansion chamber CD, for example equal to 1.5 bar at the moment of the cycle corresponding to the bottom dead center point of the piston at the end of expansion just before the exhaust valve opens.

Figure 1B:
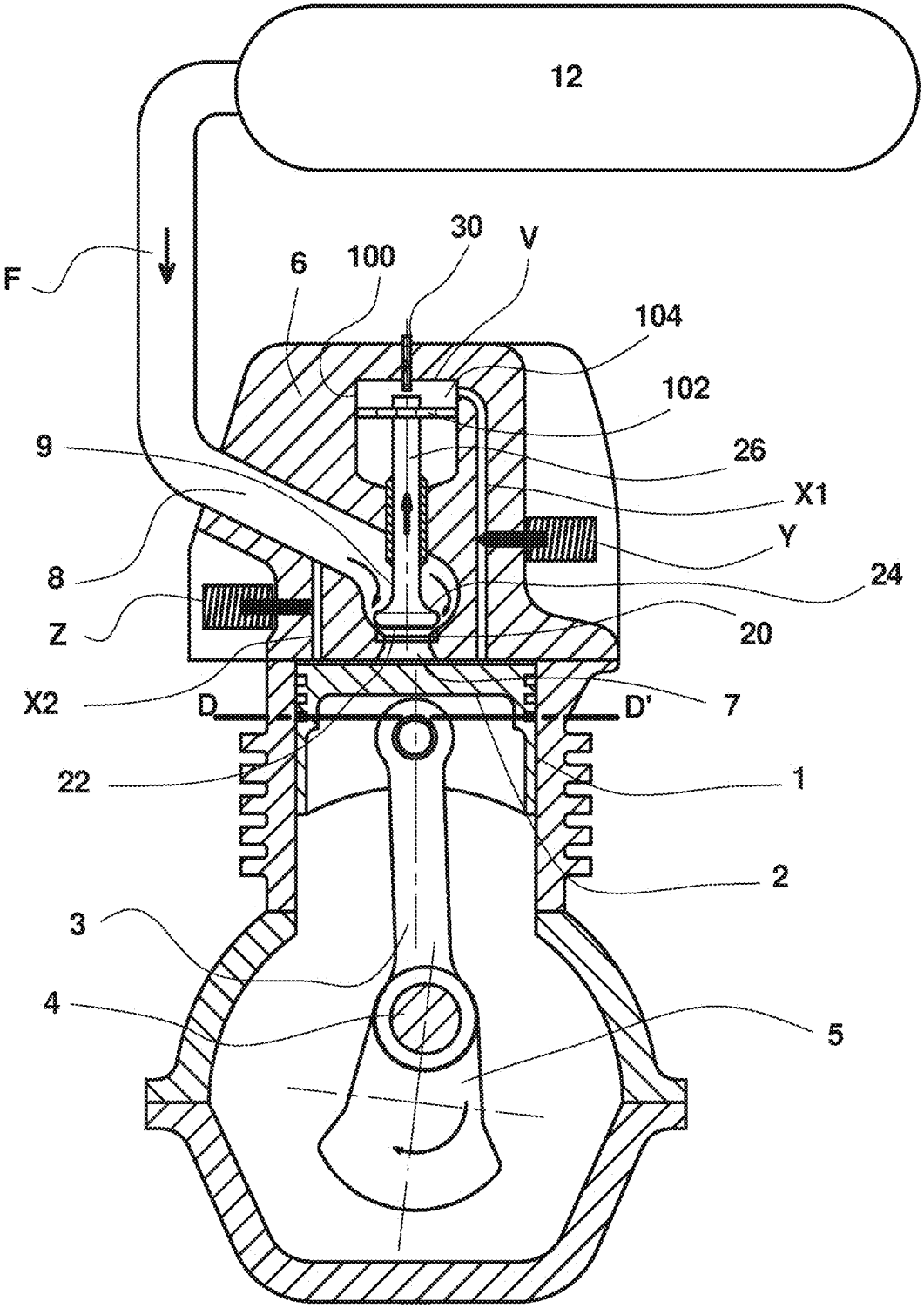
Figure 1C:
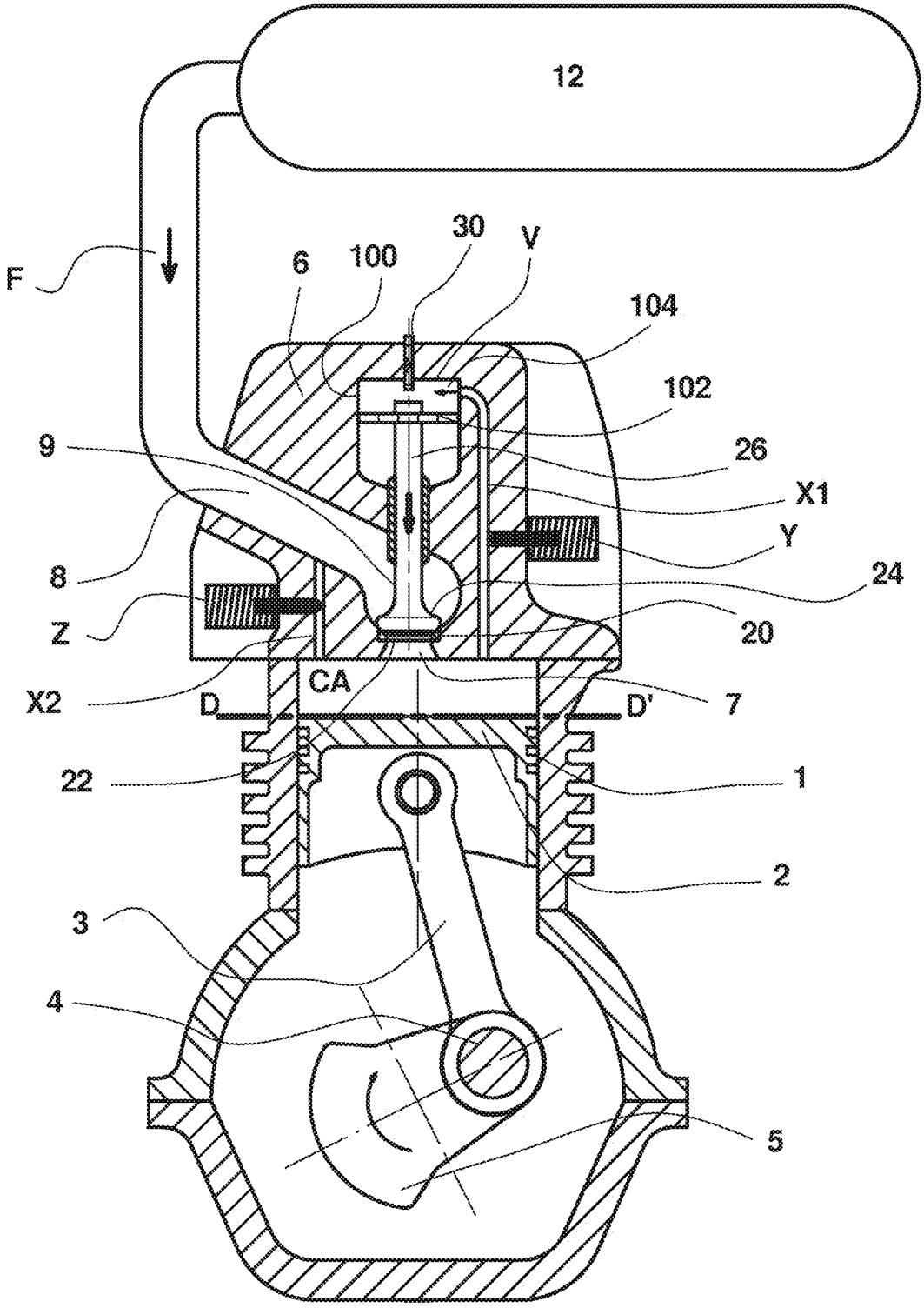
Figure 1D:
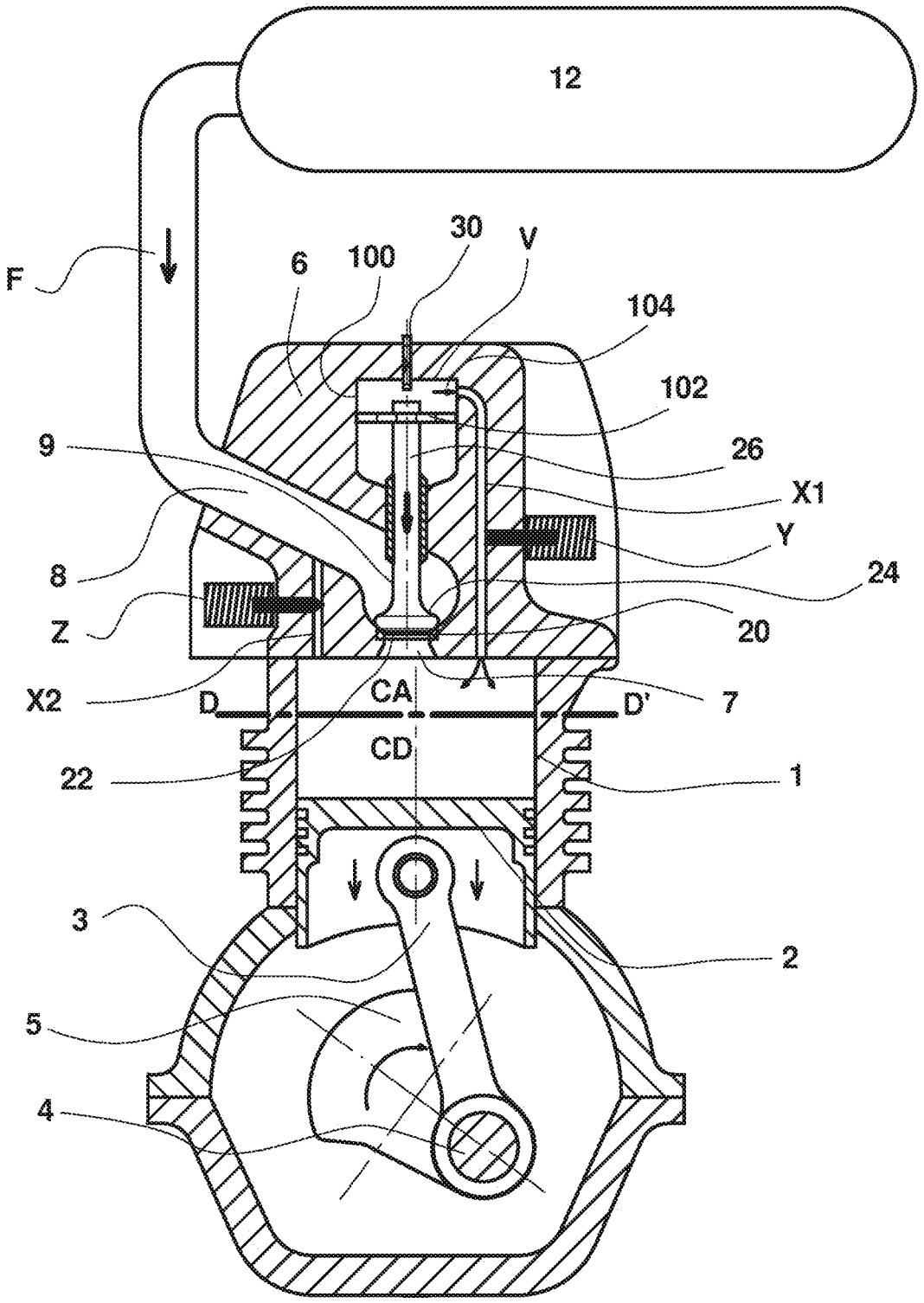

According to the invention, the intake valve 9 is mounted to be mobile so as to move in axial displacement between a low closing position (considering the vertical general orientation of the figures and without reference to terrestrial gravity)—represented in FIG. 1A—in which it bears in a sealed manner on its valve seat 20 and a high open position—represented in FIG. 1B.

In its opening direction, the intake valve 9 moves axially—upward, in the direction opposite to that of the flow of the flow F of gas under pressure for filling the cylinder. The intake valve therefore opens in the opposite direction to the flow of air under pressure for filling the cylinder of the engine.

In its closed position, the intake valve 9 is held closed in autoclave fashion on its valve seat 20 by the pressure in the intake duct 8 and applied to the intake valve, i.e. to the head of the valve inside the intake duct 8.

The engine includes means for commanding opening of the intake valve 9 substantially at the top dead center point of the travel of the piston to cause the intake valve 9 to be lifted off its seat 20 and to make it possible to establish in the active chamber a pressure equal to that in the intake duct 8.

During its opening phase, the valve therefore travels its entire opening travel under the action of the differential pressure forces exerted by the gas under pressure on the corresponding parts of the intake valve and notably on the head of the valve, i.e. on the one hand on the lower surface 22 of disk shape subjected to the pressure in the cylinder 1 and on the other hand on the upper surface 24 subjected to the pressure in the intake duct 8, the difference between the areas of these two surfaces substantially corresponding to the area of the section of the stem 26 of the valve 9.

In its closed position, the intake valve 9 is held on its seat 20 in autoclave fashion by the pressure of the compressed air contained in the intake circuit and/or in the compressed air storage tank 12, the pressure in the active chamber CA and the expansion chamber CD of the engine being lower during the expansion and exhaust phases of operation.

The engine includes a pneumatic actuator V for closing the intake valve 9 which, by way of nonlimiting example, is here arranged in the cylinder head 6.

The actuator V includes an actuator cylinder 100 and a closure piston 102 that is connected to move axially with the stem 26 of the intake valve 9 and that is mounted to slide in the actuator cylinder 100 inside which it defines in a sealed manner an upper chamber 104 called closure chamber of the actuator of the valve 9.

The engine has an active distribution channel X1 that connects the closure chamber 104 to the upper part of the active chamber CA included in the cylinder 1.

The high maximum open position of the intake valve 9 is defined by an adjustable stop 30 that extends into the chamber 104 and the axial position in the axial direction of movement of the valve is controlled (by means not represented in the figures) to vary the flow rate of gas under pressure admitted into the cylinder via the intake duct. The controlled adjustable stop therefore serves as a "butterfly valve" controlled by an accelerator. The movements of the stop are produced and controlled by an electric stepper motor, for example.

The adjustable stop 30 makes it possible to stop the automatic upstroke of the intake valve 9 by modifying its lift as a function of required operating parameters of the engine.

The engine includes a control valve Y for blocking the circulation of the gas in the active distribution channel X1, called active distribution valve Y, opening of which may be commanded to put the chamber 104 for closing the intake in communication with the upper part of the active chamber CA by establishing in the closure chamber 104 a complementary pressure on the upper face of the piston 102, the action of this piston pushing the intake valve 9 onto its seat 20 and therefore closing the intake circuit and thereby terminating the work of the active chamber CA.

The active distribution valve Y is then held open during the expansion time, allowing the compressed gas contained in the closure chamber 104 to expand conjointly with the gas contained in the expansion chamber, producing work that is added to the work of the charge of gas under pressure previously admitted into the active chamber via the intake duct.

The engine includes a channel X2 for controlling the opening of the intake valve 9 that connects the upper part of the active chamber CA to the intake duct 8.

The engine includes a controlled valve Z for blocking the circulation of the gas into the channel X2, called intake valve opening valve, opening of which may be commanded to put the upper part of the active chamber CA in communication with the intake duct 8.

When the piston 2 of the engine is close to its top dead center point (FIG. 1B), by opening the opening valve Z the intake circuit is at the required time put in communication with the active chamber CA of the cylinder, enabling the establishing therein of a pressure identical to that in the intake circuit and, because of the area difference mentioned above, the pressure automatically pushes the intake valve 9 upwards and as it moves the intake valve opens the intake circuit.

For example, for a 20 mm diameter valve controlled by a 6 mm valve stem, the lower area is equal to 3.14 $cm^2$ and the upper area is equal to 2.86 $cm^2$ (3.14–0.28), a thrust of 28 kg is exerted to open the intake valve 9 automatically and to allow the filling of the active chamber CA.

The intake valve 9 is then closed by putting the active chamber CA in communication with the closure chamber 104 thereby creating a complementary pressure on the upper surface of the piston 102 of the closing actuator V that then pushes the intake valve 9 onto its seat 20 and closes/blocks the intake to enable the expansion cycle from the active chamber CA into the expansion chamber CD.

As soon as expansion begins (FIG. 1C) the volume of the closure chamber 104 is maintained in communication with the expansion chamber CD of the engine and the compressed air contained in the closure chamber 104 expands into the expansion chamber CD of the engine, producing work that is added to the work of expansion of the charge admitted into the active chamber.

Accordingly, in the context of the invention, the valve Y is an active distribution valve and the channel X1 is an active distribution channel.

At the end of expansion, the communication between the active chamber and the expansion chamber of the cylinder and the closure chamber 104 is again blocked, maintaining in the latter a pressure close to atmospheric pressure, enabling a new cycle.

The operation of the so-called active distribution according to the invention is now clear, the energy necessary for opening and closing the intake valve 9 advantageously being provided by the pressure in the storage tank and/or the intake circuit (opening) and in the active chamber (closing) and then being re-used to produce additional work in the cylinder.

The volume of the closure chamber 104 is small, by way of nonlimiting example less than 10% of the cubic capacity of the cylinder 1.

The same applies in respect of the channels connecting the intake and the active chamber and the closure chamber 104 to the expansion chamber CD, the passage sections of which are calculated to allow a sufficient flow rate to establish the pressures in the various chambers.

These various channels have small diameters, for example of the order of 0.5 to 2 millimeters for a main intake duct of the order of 20 millimeters.

Valves Y and Z of the electromechanical type will preferably be used, preferably in the form of appropriate solenoid valves easily controlled by an electronic management unit (not represented).

Moreover control by an electronic management unit and pneumatic drive makes possible speeds of opening and of closing of the valve or valves and angular control phases of great accuracy.

In the operating cycle of the active distribution described above the volume of air contained in the closure chamber is expanded conjointly with that of the active chamber and ignoring the head losses on going from the nominal pressure to the exhaust pressure.

Figure 2:
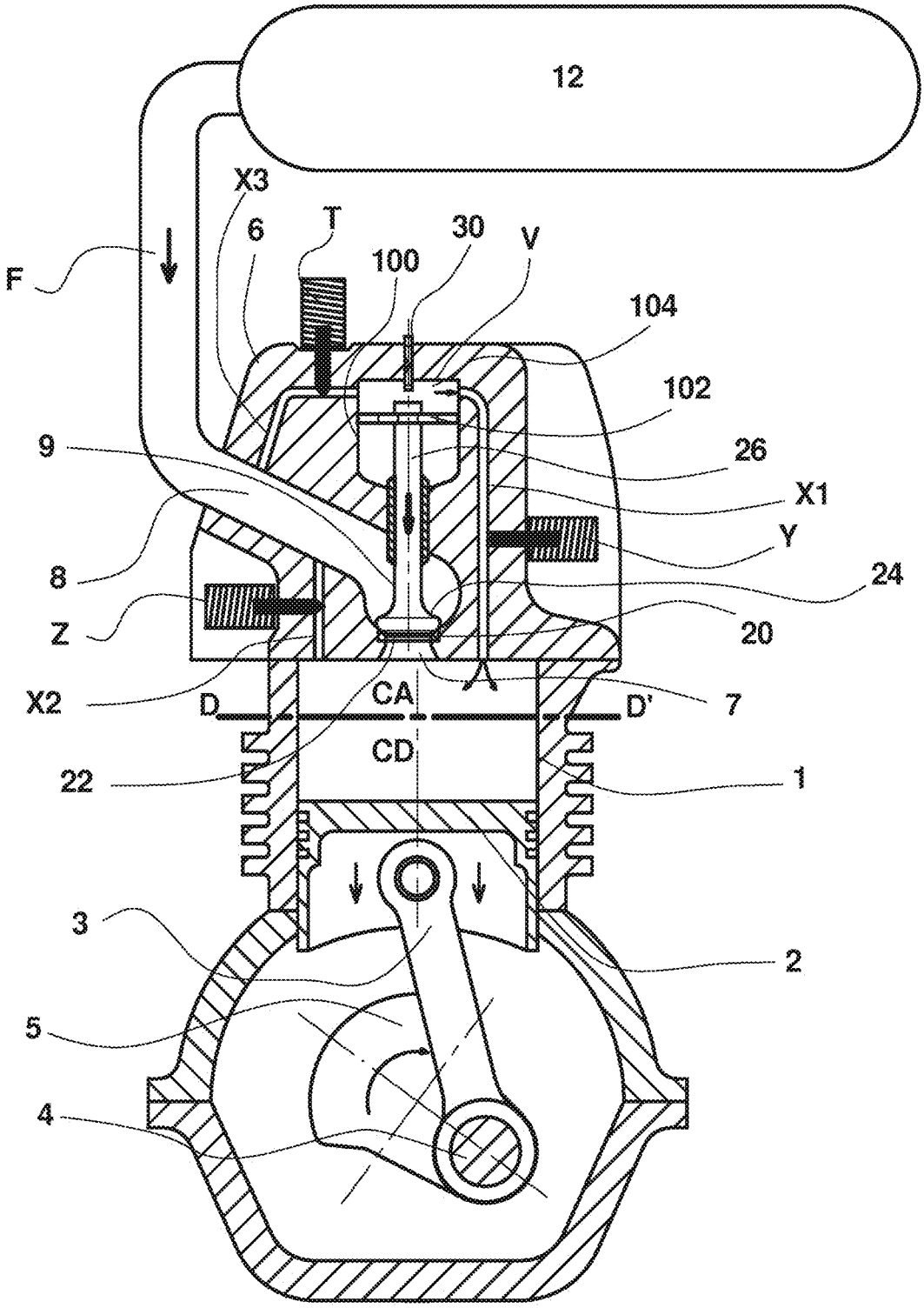
FIG. 2 is a view analogous to that of FIG. 1D that illustrates an engine according to a second embodiment of the invention.

Description of FIG. 2

The following description is given by way of comparison with the embodiment described above with reference to FIGS. 1A to 1D.

The previous design is completed by an additional channel X3 that connects the intake duct 8 to the closure chamber 104 of the actuator V.

The engine also includes a controlled valve T for blocking the circulation of the gas, of the compressed air, in the channel X3, the opening of which may be commanded to put the intake duct 8 and/or the tank 12 in communication with the closure chamber 104.

Thus the closure chamber 104 has at least two ducts X3 and X1 each including controlled blocking means T and Y making it possible to put the closure chamber 104 successively in communication with on the one hand the intake circuit and/or the high-pressure storage tank 12 and on the other hand the active and expansion chamber of the cylinder.

The intake valve 9 is closed by putting the intake circuit and/or the storage tank in communication with the closure chamber 104 via the channel X3 and by commanding opening of the valve T, thereby creating a complementary pressure on the surface of the closure piston 102 that pushes the intake valve 9 onto its seat 20 and closes the intake to allow the cycle of expansion from the active chamber CA into the expansion chamber CD.

Thus the active expansion from the closure chamber 104 can be delayed to occur later in the cycle by controlling opening of the valve Y.

As soon as expansion begins or during expansion the volume of the closure chamber 104 is put in communication with the expansion chamber CD and the compressed air contained in the closure chamber 104 expands into the expansion chamber CD producing work that is added to the work of expansion of the charge admitted into the active chamber CA.

At substantially the end of expansion, the communication between the active and expansion chamber of the engine and the closure chamber 104 is again blocked, maintaining in the latter a pressure close to atmospheric pressure allowing a new cycle.

Figure 3:
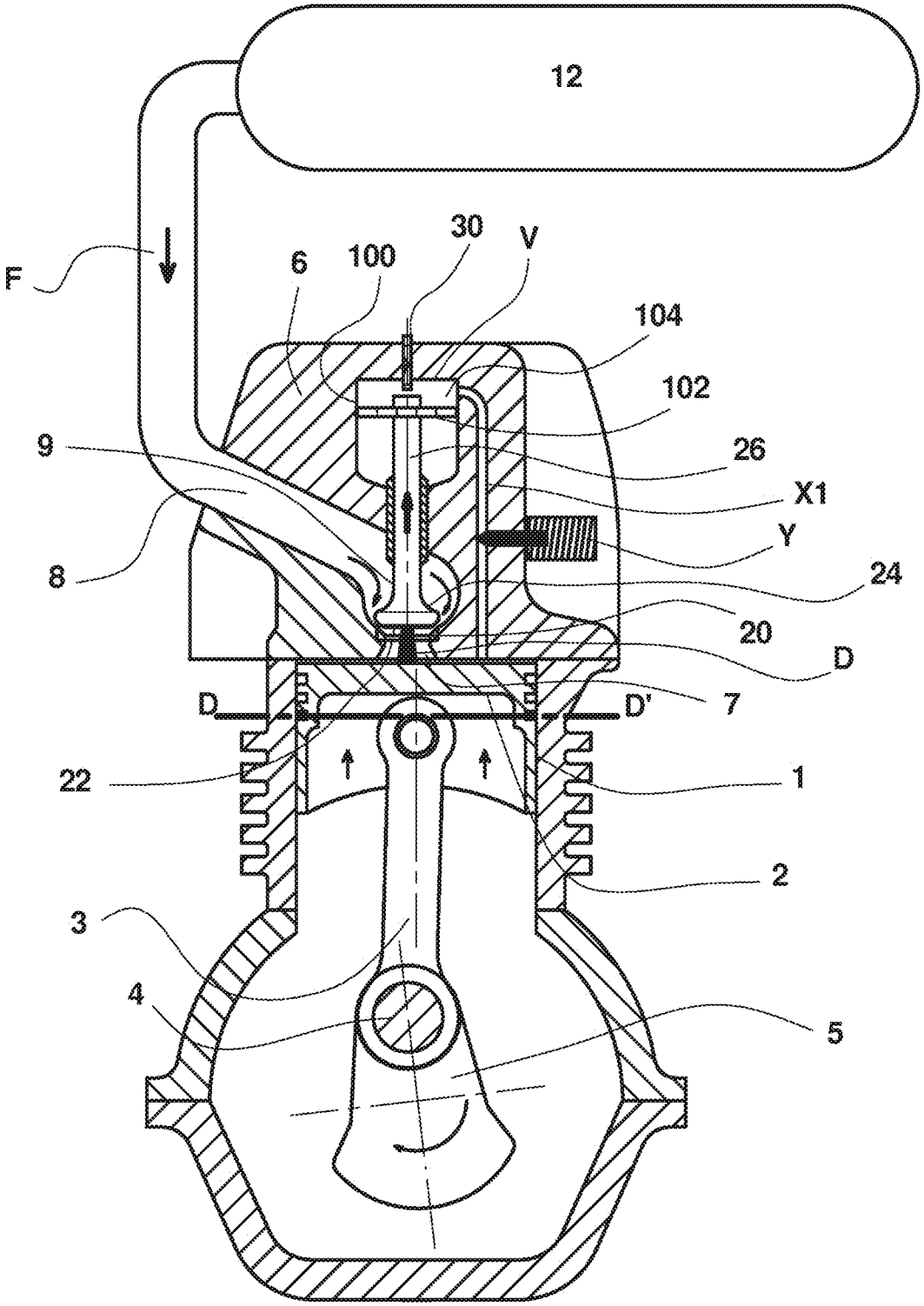
FIG. 3 is a view analogous to that of FIG. 1B that illustrates an engine according to a third embodiment of the invention.

Description of FIG. 3

The following description is given by way of comparison with the first embodiment shown in FIGS. 1A to 1D.

According to this embodiment there are provided mechanical means (rather than pneumatic means) for causing the intake valve 9 to be lifted off its seat 20 that act directly on the head of the intake valve 9.

The opening of the intake valve 9 is advantageously simplified by the integration of such a mechanical device in the case of an engine that has to operate at substantially constant rotation speeds and therefore necessitates no variation of the calibration of the intake opening.

To this end, said means for controlling opening of the intake valve 9 consist of a finger D or plunger upstanding on the upper face of the piston (2) and that extends vertically upwards, facing the facing head of the intake valve 9.

By virtue of its arrangement and its dimensions, the finger D controlling opening is able to cooperate mechanically with the lower face 20 of the head of the intake valve 9 to push the latter vertically upwards.

It is during the end of the travel of the piston toward its top dead center point that the finger D acts via the intake orifice on the facing portion of the lower face 22 of the head of the intake valve 9 to lift it from its seat.

The finger D is positioned in line with the lower part of the head of the intake valve so that it raises the intake valve slightly, creating a leak that puts the intake circuit in communication with the active chamber CA, establishing in the closure chamber 104 a complementary pressure on the upper surface of the piston 102 and, by the action of the piston 102 connected to the stem of the valve, pushing the intake valve 9 onto its seat 20, thus closing the intake circuit and terminating the work of the active chamber CA.

The valve then travels its complete opening travel under the action of the differential pressure forces exerted by the gas under pressure on the corresponding parts of the intake valve 9.

After the intake valve opens and the expansion cycle begins, because of the descent of the piston 2 the finger D no longer acts on the intake valve 9 and the remainder of the cycle is identical to that described with reference to FIGS. 1A to 1D, using the valve Y.

Figure 4:
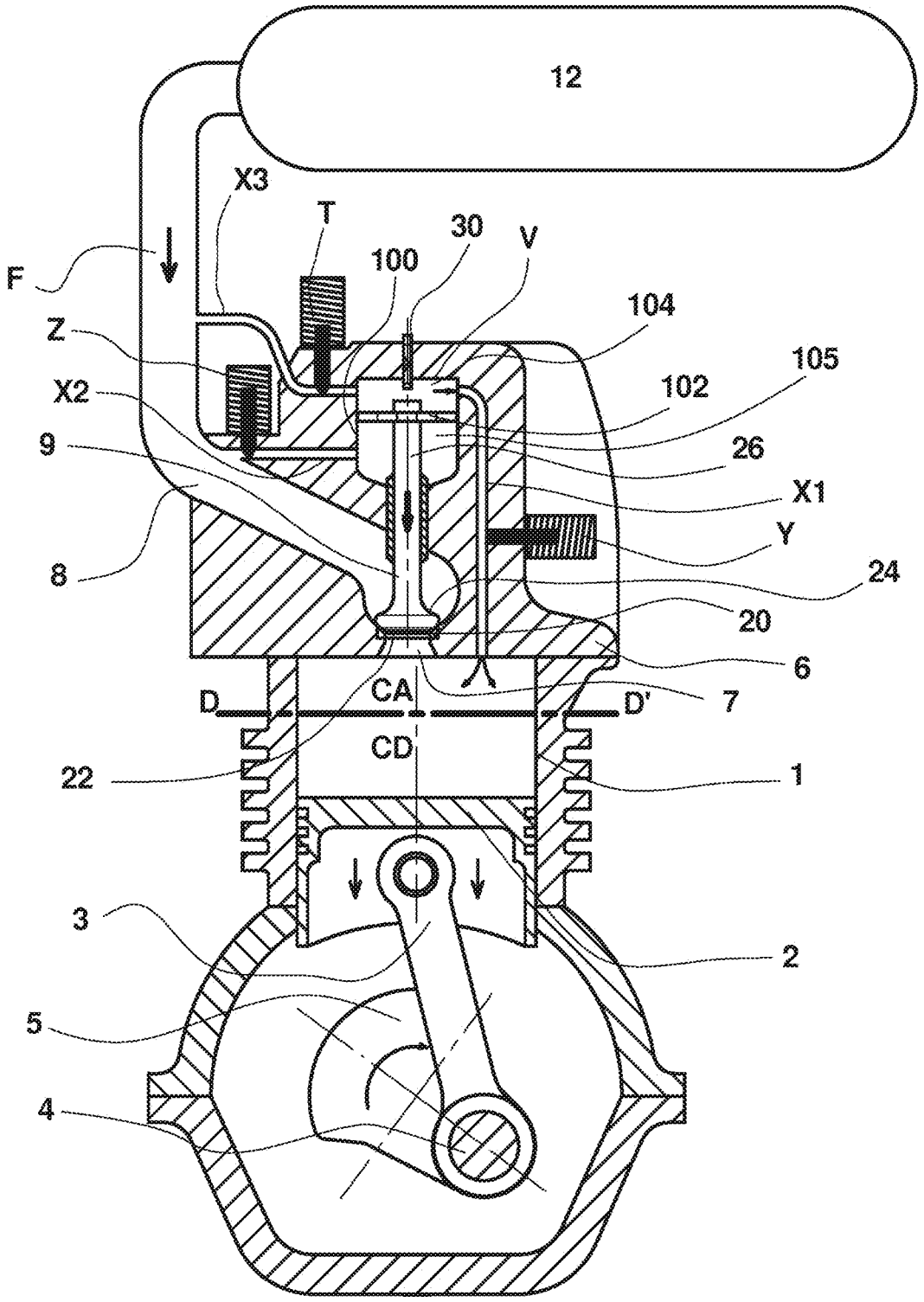
FIG. 4 is a view analogous to that of FIG. 1D that illustrates an engine according to a fourth embodiment of the invention.

Description of FIG. 4

The following description is given by way of comparison with the second embodiment shown in FIG. 2.

The arrangement of the channel X2 and of the associated valve Z controlling opening of the intake valve is modified.

The actuator V is a double-acting actuator with two sealed chambers separated by the piston 102.

The lower chamber 105 is a chamber controlling opening of the intake valve 9 which is connected via the channel X2 to the intake duct 8 and/or to the tank 12 of gas under pressure.

Thus the closure chamber 104 has at least two ducts X3 and X1 each including blocking control means T, Y making it possible to put the closure chamber 104 successively in communication with on the one hand the intake circuit and/or the high-pressure storage tank 12 and on the other hand the active and expansion chamber of the cylinder.

The opening of the intake valve 9 is commanded by the valve Z which feeds the lower chamber 105 of the actuator V, which is an opening chamber, with gas under pressure.

The intake valve 9 is closed by putting the intake circuit and/or the storage tank in communication with the closure chamber 104 via the channel X3 and by commanding opening of the valve T, thereby creating a complementary pressure on the surface of the closure piston 102 that pushes the intake valve 9 onto its seat 20 and closes the intake to allow the cycle of expansion from the active chamber CA into the expansion chamber CD.

The closure is obtained by virtue of the fact that the area of the piston 102 subjected to the pressure is higher on the side of the chamber 104 than on the side of the opening chamber 105 (the difference substantially corresponding to the area of the section of the stem of the intake valve).

The active expansion from the closure chamber can therefore be delayed to occur later in the cycle by controlling the opening of the valve Y.

As soon as expansion begins or during expansion the volume of the closure chamber 104 is then put in communication with the expansion chamber CD and the compressed air contained in the closure chamber 104 expands into the expansion chamber producing work that is added to the work of expansion of the charge admitted into the active chamber.

At substantially the end of expansion the communication between the active and expansion chamber of the engine and the closure chamber 104 is again blocked by maintaining in the latter a pressure close to atmospheric pressure allowing a new cycle.

According to this design, the piston 102 of the actuator V successively commands opening and closing of the intake valve 9.

According to a variant, not represented, it is possible, as for the chamber 104, to connect the chamber 105 to the active chamber thanks to a channel X1' and a valve Y', thereby producing two parallel active distribution circuits.

The volumes of the closure chamber 104 and the opening chamber 105 can then be put in communication with the expansion chamber and the compressed air that is contained therein expands into the expansion chamber making it possible to increase the work of expansion of the admitted charge on expanding into the main drive cylinder.

Because of the flexibility of utilization and of the virtually unlimited adjustment possibilities, the engine equipped with the "active" intake distribution according to the invention may be used on all terrestrial, maritime, rail, aeronautical vehicles. The active chamber engine according to the invention may also and advantageously find an application in standby generator sets, likewise in numerous domestic cogeneration electricity, heating and air conditioning applications.

The active chamber engine according to the invention has been described with operation with compressed air. However, it may use any compressed gas/gas at high pressure without this departing from the field of the claimed invention.

The invention is not limited to the embodiments described and represented: the materials, control means, devices described may vary within the limit of equivalence to produce the same results. The number of engine cylinders, their cubic capacity, the maximum volume of the active chamber relative to the displaced volume of the cylinder(s) and the number of expansion stages may vary.

The invention claimed is:

1. An active chamber engine operating according to a three-phase thermodynamic cycle including an isobaric and isothermal transfer phase, a phase of polytropic expansion with work, and an exhaust phase at ambient pressure, the engine comprising:

- at least one cylinder fed with a gas under pressure contained in a high-pressure storage tank;
- at least one piston that is mounted to slide in the at least one cylinder;
- a crankshaft driven by the piston via a connecting rod and crank device;
- a cylinder head that closes the volume of the cylinder at the top, which is swept by the piston, and which includes
  - at least one intake duct in which a flow of gas under pressure flows to fill the cylinder,
  - an intake orifice for the gas under pressure above the piston, and
  - at least one exhaust orifice and one exhaust duct, the cylinder head being arranged so that, when the piston is at its top dead center point, the residual volume contained between the piston and the cylinder head is, by construction, reduced to only the minimum gaps enabling contactless operation between the piston and the cylinder head;

at least one intake valve that cooperates in a sealed manner with a valve seat formed in the cylinder head and which defines the intake orifice;

wherein the volume of the cylinder swept by the piston is divided into two distinct parts, a first part of the two distinct parts constituting an active chamber that is included in the cylinder and a second part of the two distinct parts constituting an expansion chamber, under the continuous thrust of the gas under pressure admitted into the cylinder, at constant working pressure, the volume of the active chamber increases and produces work representing the isobaric and isothermal transfer phase, the admission of the gas under pressure into the cylinder is blocked when the maximum volume of the active chamber is reached, the quantity of gas under pressure contained in said active chamber then expanding and pushing back the piston over the second part of its travel which defines the expansion chamber and produces work therefore ensuring the polytropic expansion phase, when the piston reaches its bottom dead center point, the exhaust orifice is then opened to ensure the exhaust phase during the upstroke of the piston over the entirety of its travel to its top dead center point, the torque and the speed of the engine are controlled by opening and closing the intake valve enabling opening of the intake valve substantially at the top dead center point of the travel of the piston and enabling, by closing the intake valve, modification of an intake duration and/or angular sector, and a passage section of the intake orifice in order, as a function of the pressure of the compressed gas contained in the storage tank and the pressure at the end of the expansion phase, to define the quantity of gas under admitted pressure admitted and the volume of the active chamber, the intake valve is mounted to be mobile in axial displacement between a low closed position in which the intake valve bears in a sealed manner on the valve seat and a high open position, in its opening direction, the intake valve moves axially in the direction opposite to that of the flow of the flow of gas under pressure for filling the cylinder, in its closed position, the intake valve is maintained closed in an autoclave manner on the valve seat by the pressure in the intake duct and applied to the intake valve, the engine further comprises a controller configured to control opening of the intake valve, substantially at the top dead center point of the travel of the piston, to cause the intake valve to lift off the valve seat to enable the establishing of the intake pressure in the active chamber, the valve then travelling its complete opening travel under the action of the differential pressure forces exerted by the gas under pressure on the corresponding parts of the intake valve;

a pneumatic actuator configured to close the intake valve, the pneumatic actuator including an actuator cylinder and a closing piston that is connected to the intake valve to move axially with the intake valve and that is mounted to slide in the actuator cylinder inside which the closing piston defines in a sealed manner a control closure chamber of the actuator;

at least one intake connection channel that connects the intake duct to a source of gas under pressure that is the upper part of the active chamber of the cylinder or the intake duct or the tank of gas under pressure;

an active distribution channel that connects said closure chamber to the upper part of the active chamber and an active distribution valve configured to block the circulation of the gas in the active distribution channel, the opening of which is controlled to place the closure chamber in communication with the upper part of the active chamber, to close the intake valve and to produce work that is added to the work of the charge of gas under pressure previously admitted into the active chamber via the intake duct.

2. The engine according to claim 1, wherein the active distribution valve is controlled according to the following cycle:

opening of the active distribution valve to put the closure chamber in communication with the active chamber to cause the closing of the intake valve and then, during the expansion phase, to enable the expansion of the compressed gas contained in the closure chamber into the expansion chamber of the cylinder, producing work that is added to the work of the charge of gas under pressure previously admitted into the active chamber via the intake duct, and at the end of the expansion phase, reclosing the active distribution valve to maintain in the interior of the closure chamber the pressure of the expanded gas the value of which is close to that of atmospheric pressure.

3. The engine according to claim 2, wherein the controller includes:

an active chamber connection channel that connects the upper part of the active chamber to the intake duct or to the tank of gas under pressure and that serves to control opening of the intake valve, and a controlled opening valve configured to block the circulation of the gas in the active chamber connection channel that controls opening.

4. The engine according to claim 3, wherein the opening control valve is controlled according to the following cycle:

at the end of the exhaust phase, when the piston is substantially at the top dead center point of its travel, opening said opening control valve to enable establishing in the active chamber a pressure identical to a pressure in the intake duct and to cause the intake valve to lift off the valve seat, the intake valve then travels its complete opening travel under the action of the differential pressure forces exerted by the gas under pressure on the corresponding parts of the intake valve, and closing said control valve when the intake valve opens.

5. The engine according to claim 2, further comprising:

a closure chamber connection channel that connects said closure chamber to the intake duct and/or to the tank of gas under pressure; and a blocking valve configured to block the circulation of the gas in this the closure chamber connection channel, the opening and then the closing of which are controlled to cause the closing of the intake valve, before the closure chamber is put into communication with the volume of the cylinder swept by the piston.

6. The engine according to claim 1, wherein the controller includes a finger upstanding on the upper face of the piston which, during the end of the travel of the piston toward its top dead center point, acts via the intake orifice on a facing orifice of the intake valve to lift the intake valve off the valve seat.

7. The engine according to claim 6, wherein the active distribution valve is controlled according to the following cycle:

opening the active distribution valve to put the closure chamber in communication with the active chamber to put the closure chamber in communication with the expansion chamber of the cylinder to enable the expansion of the compressed gas contained in the closure chamber into the expansion chamber of the cylinder, producing work that is added to the work of the charge of gas under pressure previously admitted into the active chamber, and at the end of the expansion phase, reclosing the active distribution valve to maintain in the interior of the closure chamber a pressure the valve of which is close to that of atmospheric pressure.

8. The engine according to claim 1, wherein the high maximum open position of the intake valve is defined by an adjustable stop, the axial position of which in the direction of movement of the intake valve is controlled to vary the flow rate of gas under pressure admitted into the cylinder via the intake duct.

9. The engine according to claim 1, wherein the air is compressed air.

* * * * *